United States Patent [19]

Boes, deceased et al.

[11] Patent Number: 4,975,210

[45] **Date of Patent: * Dec. 4, 1990**

[54] PHTHALOCYANINE COMPLEX-FILLED FLUIDS

[75] Inventors: David J. Boes, deceased, late of Monroeville, Pa., by Patricia K. Boes, executrix; Mary A. Alvin, Pittsburgh, Pa.

[73] Assignee: Westinghouse Electric Corp., Pittsburgh, Pa.

[ * ] Notice: The portion of the term of this patent subsequent to Sep. 6, 2005 has been disclaimed.

[21] Appl. No.: 272,359

[22] Filed: Nov. 17, 1988

[51] Int. Cl.[5] ..... C10M 119/30

[52] U.S. Cl. ..... 252/46.4; 252/49.7; 252/52 R; 252/54; 252/56 R

[58] Field of Search ..... 252/46.4, 49.7, 52 R, 252/54, 56 R

[56] References Cited

U.S. PATENT DOCUMENTS

| | | | |
|---|---|---|---|
| 2,597,018 | 5/1952 | Merker et al. | 252/42.7 |
| 2,836,563 | 6/1958 | Dilworth et al. | 252/49.7 |
| 2,929,779 | 2/1960 | Sullivan et al. | 252/49.7 |
| 3,023,164 | 2/1962 | Lawton | 252/49.7 |
| 3,051,721 | 8/1962 | Pfeiffer | 252/49.7 |
| 3,265,617 | 8/1966 | Allen | 252/25 |
| 3,432,432 | 3/1969 | Dreher | 252/25 |
| 4,769,163 | 9/1988 | Boes et al. | 252/49.7 |

OTHER PUBLICATIONS

"Electrically-Conductive Group IV A Phthalocyanine Polymers," by Karl Frederick Schoch, Jr., Northwestern University (Jun., 1982).

"Cofacial Assembly of Partially Oxidized Metallomacrocyclics as an Approach to Controlling Lattice Architecture in Low-Dimensional Molecular Solids, Chemical and Architectural Properties of the 'Face-to-Face' Polymers ($[M(Phthalocyanato)0]_n$) where M=Si,-Ge,Sn," by C. W. Dirk et al., J. Am. Chem. Soc., 105, 1539 (1983).

"The Phthalocyanines, vol. II Manufacture and Applications," by F. H. Moser et al., pp. 53 to 89, CRC Press, Inc. (1983).

"Graphite Lubricant Combinations for High-Temperature Applications," by L. C. Lipp, Lubrication Engineering, vol. 22, No. 25, May (1966), pp. 187-195.

"Friction Properties of Phthalocyanine Pigments," by G. Salomon, Wear, vol. 10, No. 5, pp. 383 to 396 (1967).

*Primary Examiner*—O. Chaudhuri
*Assistant Examiner*—Jerry D. Johnson
*Attorney, Agent, or Firm*—S. R. Bramham

[57] ABSTRACT

A lubricating composition of about 90 to about 99% by weight of a lubricant and about 1 to about 5% by weight of an organometallic phthalocynaine, preferably a polymeric organometallic phthalocyanine complex, including nitrogen-substituted analogues thereof, where the complexed metal ion is preferably a Group IVA metal and provides increased time of machine operation to failure by improving oil lubricated bearing performance. Phthalocynanine peripheral ring substituents and attached to the phthalocyanine increase solubility in aqueous and organic lubricants.

8 Claims, No Drawings

PHTHALOCYANINE COMPLEX-FILLED FLUIDS

BACKGROUND OF THE INVENTION

In order to increase the life of oil or grease lubricated rotating systems that are operated at high temperatures, high speeds, and/or high loads, various additives and thickeners are sometimes added to the bearing lubricants.

It has been found, for example, that some compounds that have a lattice structure are good additives for lubricants. These include the selenides and sulfides of tungsten, molybedenum, tantalum, and nioboium. However, it has also been found that compounds that are chemically similar and that also have a lattice structure have a very poor lubricating ability. For example, tellurium is chemically very similar to selenium, but the tellurides of tungsten, molybdenum, tantalum, and niobium are very poor lubricants. Other compounds that have a lattice structure, such as calcium fluoride, are also poor lubricants at temperatures less than about 600° F. Titanium sulfide, which also has a lattice structure, is actually abrasive. Thus, it is difficult to predict from the chemical structure alone whether or not a compound that has a lattice structure will actually perform well as a lubricant.

It is highly desirable that additives in liquid lubricants be somewhat soluble in aqueous, organic or synthetic lubricants. Solid lubricant additives, such as molybdenum disulfide, are substantially more dense than that of the lubricant and thus are substantially insoluble with certain of the liquid lubricants. At turning gear speeds, the shafts of large turbine generators are not rotating at a speed sufficient to support an oil film, or hydrodynamic lubrication of the journal bearings. Thus, there is needed a composition that retains its lubricity under such a "lubricant starved" operating condition.

There remains a need for a lubricant additive with increased solubility in an organic or synthetic lubricant in order to increase the life of the lubricated mechanism.

SUMMARY OF THE INVENTION

We have discovered that an organo-metallic phthalocyanine, and preferably in a polymeric complex form, can be used as a soluble electrically conductive or extreme pressure lubricant additive. The resulting lubricant greatly extends the life of turbine or motor bearings, including journal bearings, especially, if they are run at high temperature and/or high speed, or at turning gear speed by addition of peripheral ring substituents to the phthalocyanines.

While the preferred phthalocyanine complexes used in this invention have a lattice structure, it is surprising that they function so well in oils and greases because some of the complexes have silicon-oxygen bonds which might be expected to form through decomposition highly abrasive quartz ($SiO_2$) at high temperatures.

The additives of the present invention are soluble in the oil lubricants due to the peripheral ring substituents which enhance solubility. We have found that synthetic and natural greases and oils incorporating the additives of this invention can increase the life of bearings over ten times, compared to the same grease or oil with no additive being present.

DESCRIPTION OF THE PREFERRED EMBODIMENTS

The additives of this invention are useful with any type of oil or grease, including natural, petroleum-based greases or oils, as well as synthetic lubricants. Synthetic lubricants are preferred, as they can withstand higher temperatures than can petroleum-based greases or oils.

Examples of lubricants that can be used include petroleum based lubricants, perfluoroethers, such as perfluoroalkylethers, diesters, silicones, polyphenylethers, organic grease or oil, including aromatic, chloroalkene and cyclic ethers THF, methanol, acetone, dichloromethane, trichloromethane, benzene, toluene and the like and mixtures thereof.

The organometallic phthalocyanines of this invention may be planar or polymeric and include any suitable metal M, such as lithium, beryllium, sodium, magnesium, aluminum, silicon, potassium, calcium, scandium, titanium, vanadium, chromium, nickel, copper, chlorinated copper, iron, cobalt, tin, germanium, arsenic, yttrium, zinc, manganese, gallium, zirconium, niobium, molybdenum, technetium, rhenium, rubidium, rhodium, palladium, osmium, iridium, platinum, silver, cadmium, indium, strontium, barium, lanthanum, hafnium, tantalum, tungsten, gold, mercury, tellenium, lead, actinium, protactinium, uranium, neptunium, and the like.

It is preferred that the phthalocyanines be complexes, particularly Group IVA metals, and including nitrogen-substituted analogues of such complexes. These polymer complexes have the following repeating unit, (including substitutions thereof):

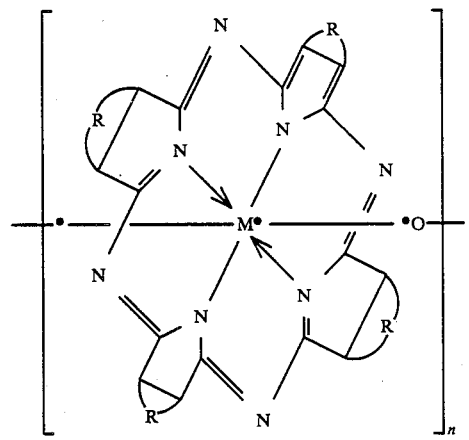

In the above general formula, the polymer chain is perpendicular to the plane of the atoms that form each repeating unit.

The peripheral ring substituents are defined by the R groups of the following formula and may be used with a planar or polymeric phthalocyanine. Each R group in the formula is a divalent organic group preferably independently selected from

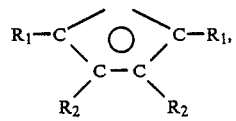

-continued

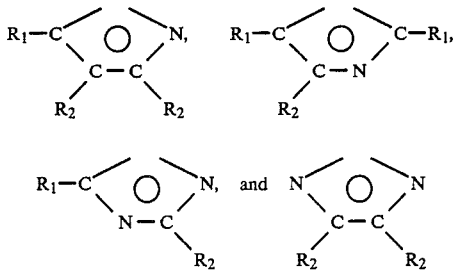

All the R groups form conjugated rings. The R group that contains only carbon atoms in the ring forms a phthalocyanine complex and provides maximum resonance stability to the polymeric complex. The R groups that contain one or two nitrogen atoms in the ring form the nitrogen-substituted analogues.

In the R groups, each peripheral ring substituted $R_1$ or $R_2$, independently, may be either organic or inorganic, and be independently selected from and more particularly may include esters, alkali metals, alkaline metals, sulfates, carboxylates, alcohols, ethers, amines; aromatic compounds such as phenyls, substituted phenyls, phenoxy, cumyl phenoxy, biphenyls; sulfonates, sulfonamides, having a formula $—SO_2NHR_3$, where $R_3$ is independently selected from hydrogen, $C_6H_4SO_3H$, and 2-hydroxy-6-sulfo-1-naphthyl; cyanates; halogenated compounds; aliphatic substitutents, including alkyls having carbon length of 1 to 4, t-butyl groups, and alkylenes having carbon length of 1-4; linear and branched nitrates; carboxylic acids; cyclic substituents of carbon length of 1 to 10, and the like.

The inorganic peripheral ring substituents such as alkali metals, alkaline metals, sulfates, carboxylates, amines, cyanates, halogenated compounds, linear and branched nitrates, carboxylic acids and the like, are preferably used with aqueous-based lubricants, perfluoroethers, polyphenyl ethers and the like.

Organic peripheral ring substituents such as esters, alcohols, ethers, aromatic compounds, aliphatic substituents, cyclic substituents and substituted phenyls, biphenyls and the like, are preferably used with synthetic lubricants, petroleum-based lubricants, diesters and the like.

Some peripheral ring substituents such as aprates, sulfonamides, amines and the like may be considered inorganic and organic in nature, and may be used with any of the above-described lubricants.

In the general formula the M atom is preferably a Group IVA metal, and more preferably each M is independently selected from silicon, germanium, and tin. The number of repeating units is represented by "n" in the formula; "n" is preferably about 10 to about 200. Preferably, each $R_1$ group, each $R_2$ group, each $R_3$ group, and the metal M in each repeating unit are identical as that simplifies synthesis.

The preparation of these polymers in which $R_1$ and $R_2$ are hydrogen has been described in the literature. See, for example, Ph.D. thesis by Karl Frederick Schoch, Jr., entitled, "Electrically-Conductive Group IVA Phthalocyanine Polymers," Northwestern University, June, 1982. The polymers as prepared are finely powdered solids.

Peripheral ring substituents may be introduced onto the phthalocyanine ring to increase the solubility of the phthalocyanine in the lubricant, especially the organic or petroleum based oils.

Peripheral ring substituents may be any substituent that enhances the solubility of the phthalocyanine skeleton in aqueous or organic solvents. The peripheral ring substituent should also possess high temperature stability. Peripheral ring substituents may be incorporated into the planar or polymeric phthalocyanines.

The peripheral ring substituent is introduced initially into the phthalocyanine ring precursor before ring cyclization and/or polymerization. Alternatively, a substituent is introduced into the ring prior to cyclization and/or polymerization, and then converted into the desired peripheral ring substituent complex.

A lubricating composition of the present invention is prepared by simply mixing the lubricating oil or grease with the additive. A suitable proportion is about 90 to about 99% (all percentages herein are by weight based as total composition weight) of the lubricant and about 1 to about 10% of the additive, and a preferred composition is about 95 to about 97% of the lubricant and about 3 to about 5% of the additive. If too much additive is used, the lubricating composition may bind, and there is no additional benefit to the use of excess additive. On the other hand, if too little additive is used, the life of the bearing will not be extended as much.

The lubricating composition of this invention can be used with any type of rolling or journal bearing, including ball bearings, roller bearings, and other types of bearings such as linear bearings. It is particularly useful with steel bearings, such as 52100 steel bearings, and may be used with stainless steel bearings as they are corrosion resistant and are more likely to be used in high-temperature, high-speed applications. However, the composition can also be used with plastic bearings and ceramic bearings, as well as with other types of bearings. The lubricating composition is particularly useful with bearings operating at temperatures between 130° F. and 600° F. in oxidizing atmospheres or in excess of 500° F. in vacuum or inert environments, as it is under those conditions that the advantages of this invention in extending the life of ball, roller or journal bearings are most obvious. For the same reason, bearings that are operated at a DN (diameter in millimeters times speed in rpm) greater than 300,000 will also benefit from the use of the lubricating compositions of this invention.

The present invention discloses a phthalocyanine, and preferably a polymeric phthalocyanine complex, that may be used as a soluble additive in synthetic and petroleum-based lubricants to increase time to failure on main shaft bearings. The preferred polymeric phthalocyanine complex may have peripheral ring substituents to enhance solubility of the phthalocyanine in the lubricant. These peripheral ring substituents may be organic or inorganic.

Whereas particular embodiments of the invention have been described above for purposes of illustration, it will be appreciated by those skilled in the art that numerous variations of the details may be made without departing from the invention as described in the appended claims.

We claim:

1. A lubricating composition comprising:

(a) about 90 to about 99 weight percent of a lubricant; and (b) about 1 to about 10 weight percent of an organometallic phthalocyanine complex with divalent organic peripheral ring substituents attached to said complex, the metal ion in said complex being of a Group IVA metal and said peripheral ring substituents being independently selected from the group consisting of

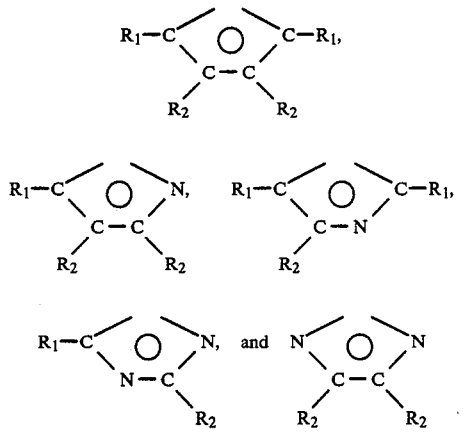

where each $R_1$ or $R_2$ may be either organic or inorganic, and independently selected from the group consisting of esters, alkali metals, alkaline earth metals, sulfates, carboxylates, alcohols, ethers, amines, aromatic groups selected from the group consisting of phenoxys, cumylphenoxys and biphenyls cyanates; halogenated groups; t-butyl groups linear and branched nitrates, carboxylic acids and cyclic groups having 1 to 10 carbon atoms.

2. A composition according to claim 1 wherein said lubricant is a synthetic lubricant.

3. A composition according to claim 1 wherein said lubricant is selected from the group consisting of perfluorethers, diesters, silicones, polyphenylethers, and mixtures thereof.

4. A composition according to claim 1 wherein said lubricant is a polymer of perfluoroalkylether.

5. A composition according to claim I wherein said lubricant is a petroleum-based lubricant.

6. A composition according to claim 1, wherein the organometallic phthalocyanine complex is polymeric and has the general formula as follows:

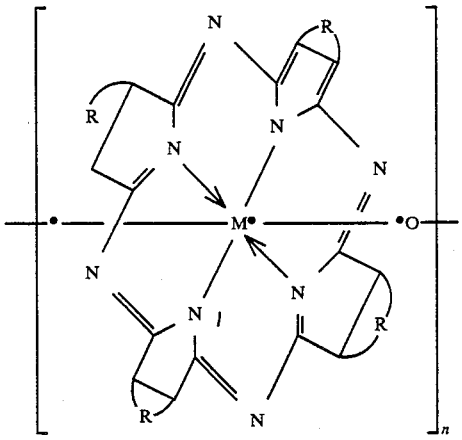

where M is the Group IVA metal ion, n is about 10 to about 200 and R represents said divalent peripheral ring substituents.

7. A composition according to claim 1, wherein said Group IVA metal is selected from the group consisting of silicon, germanium, tin and mixtures thereof.

8. A composition according to claim 1, wherein the lubricant is synthetic and selected from the group consisting of perfluoroethers, diesters, silicones, polyphenylethers and mixtures thereof, said synthetic lubricant being present in an amount of about 95 to about 97 weight percent while the organometallic phthalocyanine complex is present in an amount of about 3 to about 5 weight percent.

* * * * *